US006840792B1

(12) United States Patent
Kuan

(10) Patent No.: US 6,840,792 B1
(45) Date of Patent: Jan. 11, 2005

(54) THIN CONNECTOR

(75) Inventor: Chi-Te Kuan, Shulin (TW)

(73) Assignee: L & K Precision Technology Co., Ltd., Shulin (TW)

( * ) Notice: Subject to any disclaimer, the term of this patent is extended or adjusted under 35 U.S.C. 154(b) by 0 days.

(21) Appl. No.: 10/781,893

(22) Filed: Feb. 20, 2004

(51) Int. Cl.[7] ..... H01R 11/20
(52) U.S. Cl. ..... 439/404; 439/497
(58) Field of Search ..... 439/404, 405, 439/407, 497

(56) References Cited

U.S. PATENT DOCUMENTS 5,123,859 A * 6/1992 Davis et al. ..... 439/405
6,062,907 A * 5/2000 Tan et al. ..... 439/610
6,645,002 B1 * 11/2003 Lee ..... 439/497
2002/0004332 A1 * 1/2002 Jochen et al. ..... 439/405

* cited by examiner

*Primary Examiner*—Phuong Dinh

(57) ABSTRACT

A thin connector for connecting with cables and mate with a plug connector includes a first housing and a second housing assembled together, and a plurality of conductive terminals received in the second housing. The first housing has a first insulator, a first shell for shielding the first insulator and a longitudinal biasing plate. The second housing has a second insulator and a second shell shielding the second insulator. The conductive terminals have contact ends and pins. When the first housing and the second housing are assembled together, the pins of the conductive terminals pierce the cables for electrically connecting the conductive terminals and the cables. The biasing plate presses against the cables to avoid the cables disengaging from the thin connector, thereby achieving reliable communication and lengthened life-span.

9 Claims, 5 Drawing Sheets

THIN CONNECTOR

BACKGROUND OF THE INVENTION

1. Field of the Invention

The present invention relates to a thin connector, and particularly to a thin connector which firmly connects with cables and mates with a plug connector and which has long life-span and reliable communication performance.

2. Prior Art

A conventional thin connector, which is adapted to be assembled to cables and mate with a plug connector, comprises an insulative housing, a plurality of conductive terminals and a shell shielding the insulative housing. The insulative housing has a mating portion for mating with the plug connector and a connecting portion for connecting with the cables. The conductive terminals are received between the mating portion and the connecting portion for electrically connecting with cables and mating terminals of the plug connector.

The conductive terminals of the conventional thin connector are usually soldered to the cables. However, the cables are required to move frequently to mate with other devices. Correspondingly the cable tends to disengage from the conductive terminals of the conventional thin connector, resulting in unreliable communication and shortened life-span.

SUMMARY OF THE INVENTION

Accordingly, an object of the present invention is to provide a thin connector which reliably connects with cables for long life-span and stable communication performance.

The thin connector comprises a first housing and a second housing assembled to each other. The first housing has a first insulator, a first shell shielding the first insulator and a biasing plate. A plurality of grooves is defined through the first insulator for latching cables on a common plane. The biasing plate latches the first shell and presses the cables against the first shell. The second housing includes a second insulator and a second shell. The second insulator receives a plurality of conductive terminals therein. Each conductive terminal has a contact end and a pin. When the first housing and the second housing are assembled together, the pins pierce the cables for electrically connecting the conductive terminals and the cables.

DESCRIPTION OF THE PREFERRED EMBODIMENTS

Figure 1A:
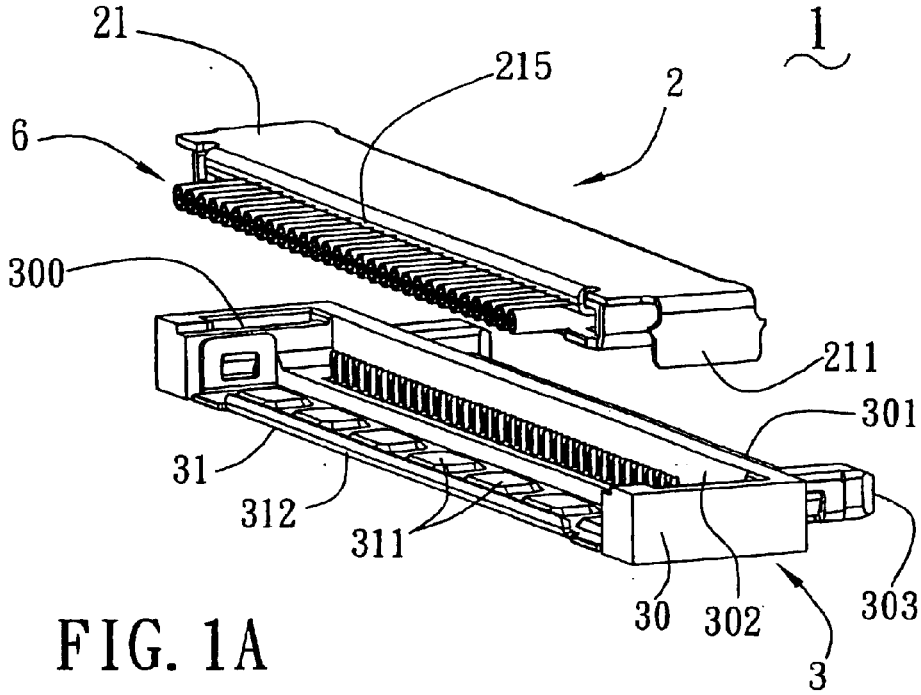
FIG. 1A is a partially exploded view of a thin connector of the present invention.
Figure 1B:
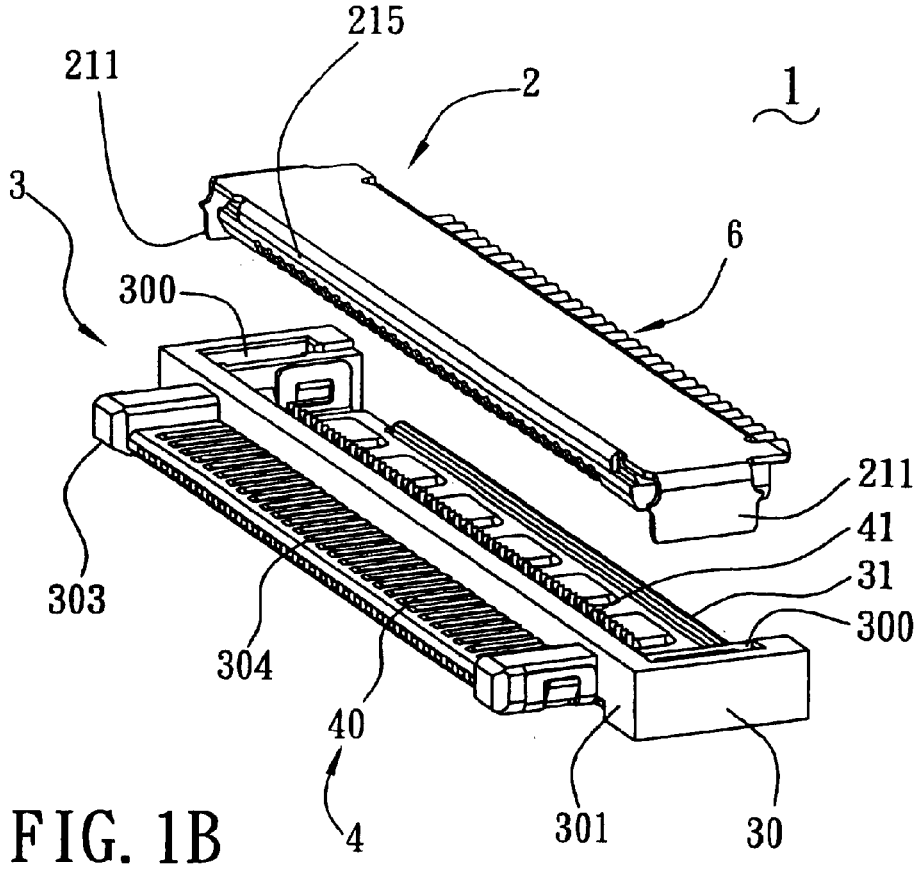
FIG. 1B is a perspective view of the thin connector of FIG. 1A, wherein the thin connector rotates clockwise of 180°.

With reference to FIGS. 1A and 1B, a thin connector 1 of the present invention comprises a first housing 2 and a second housing 3 assembled to each other.

Figure 2A:
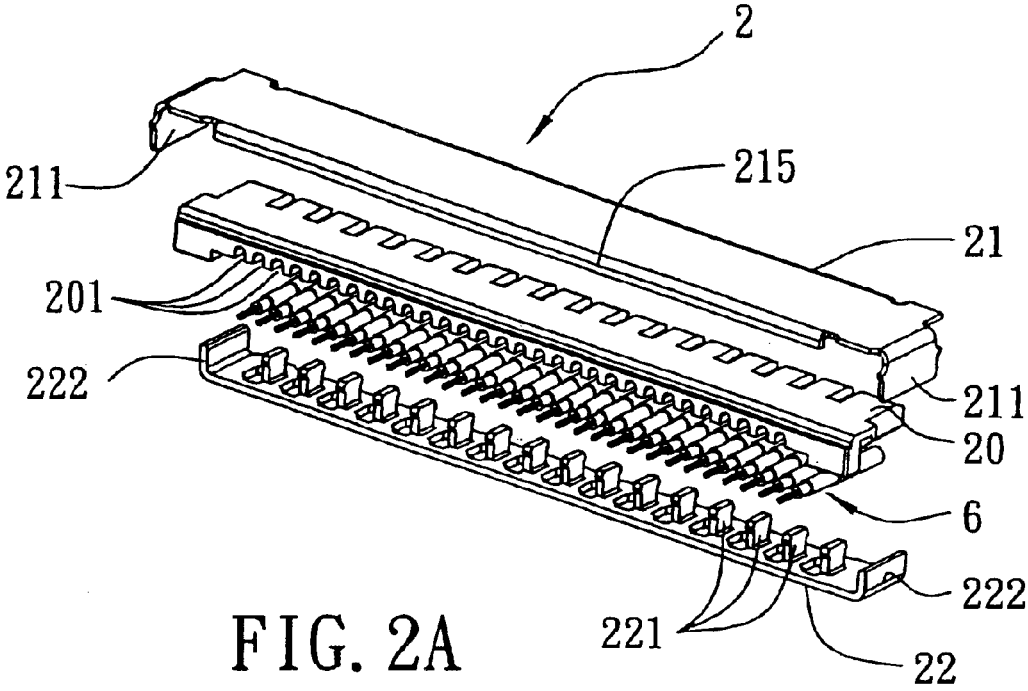
FIG. 2A is an exploded view of a first housing of the thin connector of FIG. 1.
Figure 2B:
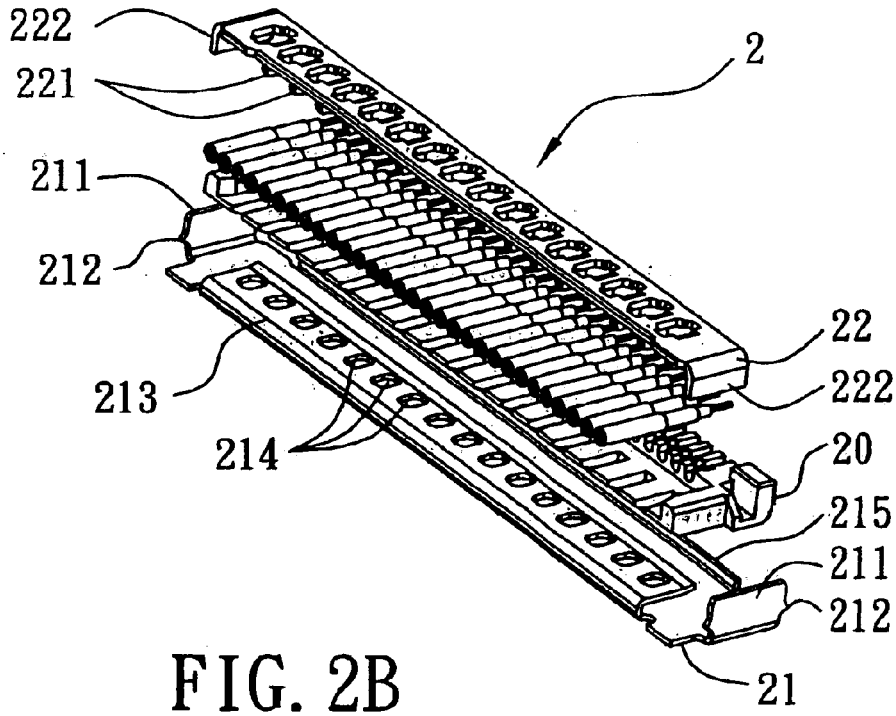
FIG. 2B is perspective view of the first housing connector of FIG. 2A, wherein the first housing rotates upside-down.

In combination with FIGS. 2A and 2B, the first housing 2 includes a first insulator 20, a first shell 21 and a biasing plate 22. The first insulator 20 is flat and rectangular and defines a plurality of grooves 201 for latching cables 6 on a common plane. The first shell 21 shields the first insulator 20. Connecting arms 211 respectively extends and bends from opposite sides of the first shell 21 and form anchors 212 at opposite edges thereof for interferentially engaging with the second housing 3. A latching tongue 213 extends and bends from and is spaced a distance from the first shell 21 and between the connecting arms 211. A plurality of channels 214 is defined in the latching tongue 213 and spaced the same distance from each other. A pressing portion 215 extends perpendicularly from a side of the first shell 21. The biasing plate 22 is longitudinal and forms a plurality of locking portions 221 for locking with channels 214. Engaging portions 222 extend and bend from opposite ends of the biasing plate 22 and have the same length as the locking portions 221.

The second housing 3 includes a second insulator 30 and a second shell 31. The second insulator 30 is rectangular and has a pair of long sides and a pair of short sides. A mating surface 301 and a connecting surface 302 are respectively on the long sides and oppose to each other. A terminal receiving portion 303 extends from the mating surface 301. A plurality of passageways 304 is defined in the terminal receiving portion 303 and through the mating surface 301 and the connecting surface 302 for receiving conductive terminals 4. Each conductive terminal 4 has a contact end 40 and a V-shaped pin 41. The contact ends 40 are adjacent to the mating surface 301 and the pins 41 are adjacent to the connecting surface 302 when the conductive terminals 4 are received in the passageways 304. A plurality of slots 300 are defined in the short sides of the second insulator 30 for engaging with connecting arms 211 of the first shell 21. The second shell 31 shields the second insulator 30 and forms a pair of uneven sides 311 for enhancing shielding performance. Supporting walls 312 extend and bend perpendicularly from the second shell 31 for pressing the cables 6.

Figure 3:
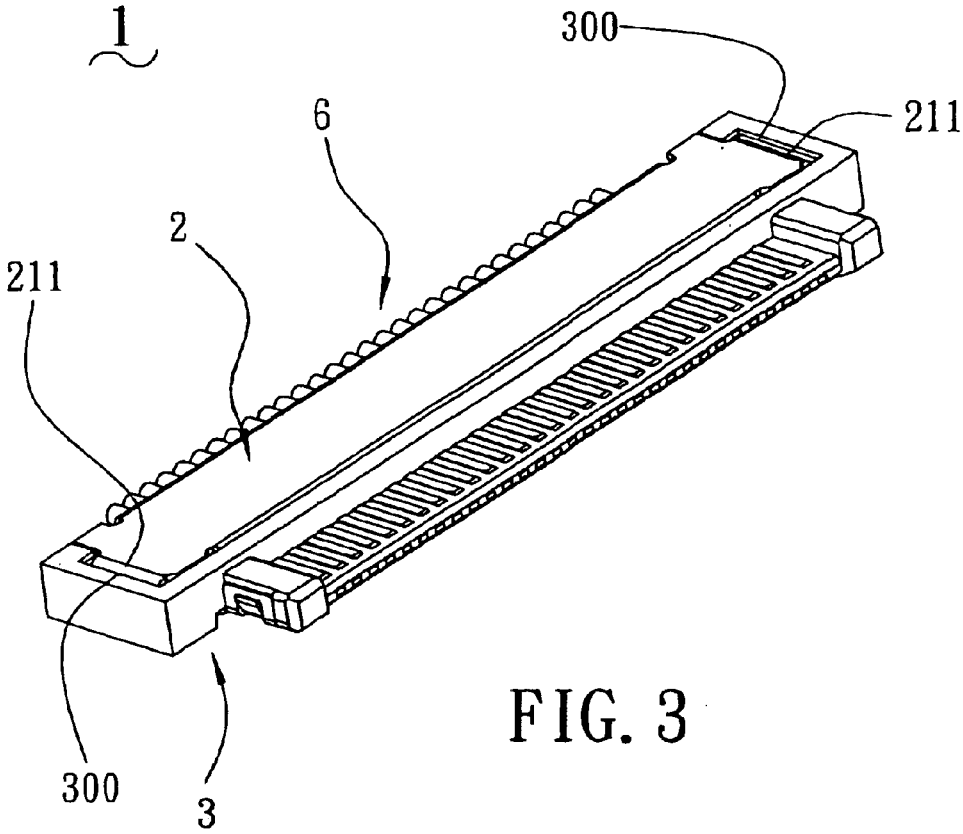
FIG. 3 is an assembled view of the thin connector of the present invention.
Figure 4:
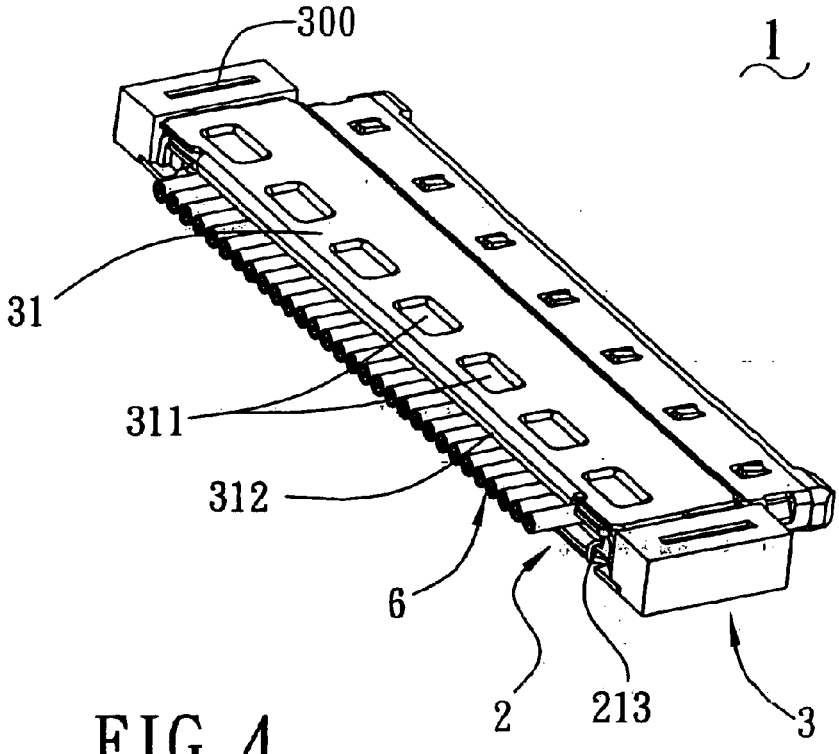
FIG. 4 is similar to FIG. 3, wherein the thin connector is viewed from another aspect.
Figure 5:
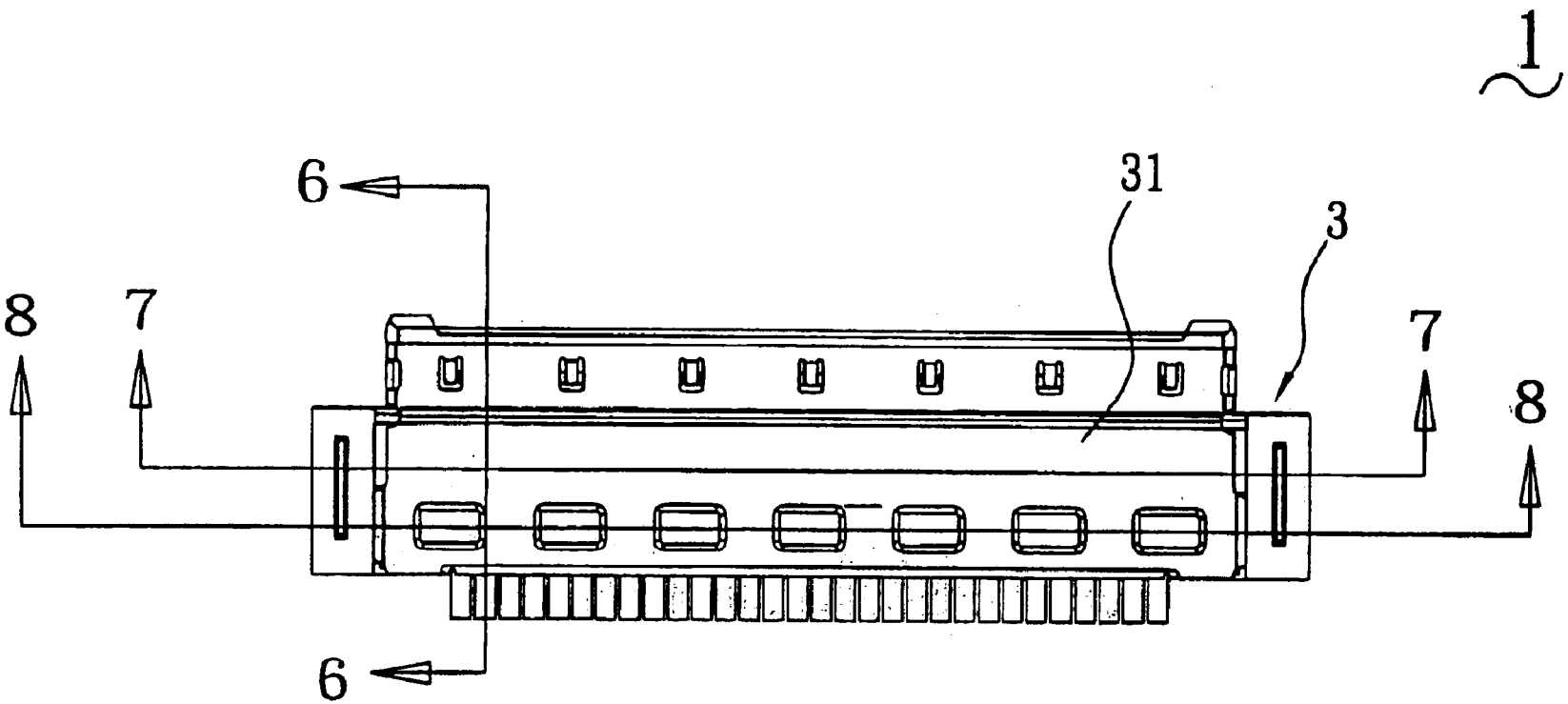
FIG. 5 is a top view of the thin connector of FIG. 4.

Referring to FIG. 3, the first housing 2 and the second housing 3 are assembled to each other. The connecting arms 211 of the first shell 21 lock the slots 300 of the second insulator 30. Viewed from another aspect, as shown in FIG. 4, the supporting walls 312 of the second shell 31 press the cables 6. Meanwhile the latching tongue 213 of the first shell 21 abuts the cables 6.

Figure 6:
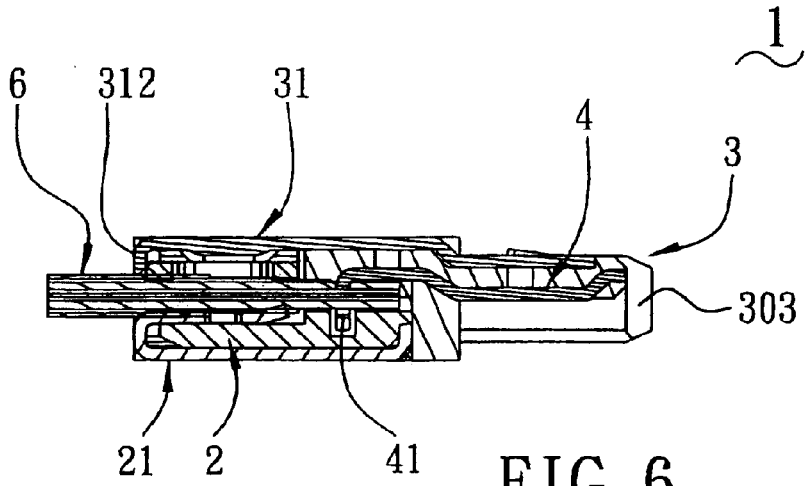
FIG. 6 is a cross-sectional view taken along the line 6—6 in FIG. 5.
Figure 7:
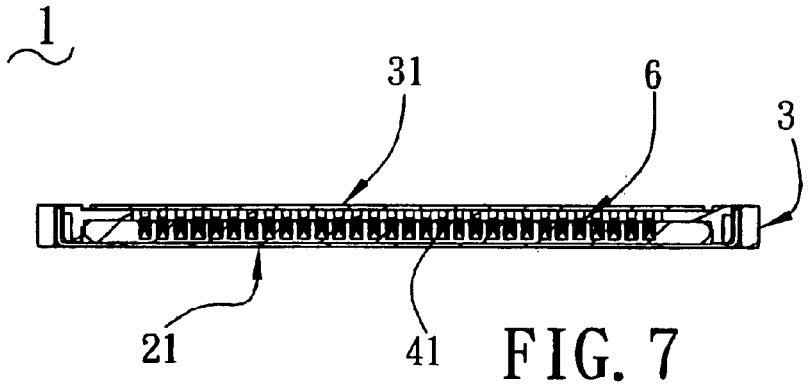
FIG. 7 is a cross-sectional view taken along the line 7—7 in FIG. 5.
Figure 8:
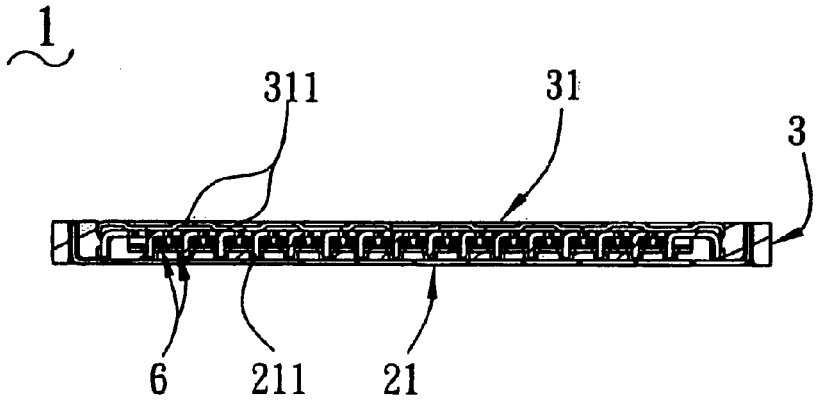
FIG. 8 is a cross-sectional view taken along the line 8—8 in FIG. 5.

During assembly of the first housing 2 and the second housing 3, referring to FIGS. 6, 7 and 8, the cables 6 are pierced by the pins 41 of the conductive terminals 4 for electrically connecting with the conductive terminals 4. Note that the locking portions 221 of the biasing plate 22 lock with the channels 214 of the latching tongue 213, thereby regularly pressing against ends of the cables 6. Thus, the biasing plate 22 biases the cables 6 against the first shell 21 to avoid the cables 6 disengaging from the conductive terminals 4 when the cables 6 move to mate with other devices, thereby assuring reliable communication- and lengthened-life-span.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A thin connector, which is adapted to connect with cables and mate with a plug connector, comprising:

a first housing including a first insulator, a first shell for shielding the first insulator and a longitudinal biasing plate, the first insulator being flat and rectangular and defining a plurality of grooves therein for latching the cables, connecting arms respectively extending and bending from opposite sides of the first shell, a latching tongue extending and bending from the first shell and between the connecting arms, a plurality of channels being defined in the latching tongue, a plurality of locking portions being defined in the biasing plate for locking with channels;

a second housing including a second insulator and a second shell for shielding the second insulator, the second insulator being rectangular and having a pair of long sides and a pair of short sides, a mating surface and a connecting surface being respectively on the long sides and opposing to each other, a terminal receiving portion extending from the mating surface, a plurality of passageways being defined in the terminal receiving portion and through the mating surface and the connecting surface; and a plurality of conductive terminal received in the passageways, and having contact ends adjacent to the mating surface and pins adjacent to the connecting surface, the pins piercing the cables for electrically connecting the conductive terminals and the cables when the first housing and the second housing are assembled together.

2. The thin connector as claimed in claim 1, wherein a pressing portion extends perpendicularly from a side of the first shell.

3. The thin connector as claimed in claim 1, wherein the connecting arms form anchors at opposite edges thereof for interferentially engaging with the second housing.

4. The thin connector as claimed in claim 1, wherein the latching tongue is spaced a distance from the first shell, and the channels are spaced the same distance from each other.

5. The thin connector as claimed in claim 1, wherein supporting walls extend and bend perpendicularly from the second shell for pressing the cables.

6. The thin connector as claimed in claim 1, wherein the pins of the conductive terminals are V-shaped.

7. The thin connector as claimed in claim 1, wherein engaging portions extend and bend from opposite ends of the biasing plate and have the same length as the locking portions.

8. The thin connector as claimed in claim 1, wherein the second shell forms a pair of uneven sides for enhancing shielding performance.

9. The thin connector as claimed in claim 1, wherein a plurality of slots is defined in the short sides of the second insulator for engaging with the connecting arms of the first shell.

* * * * *